US005413642A

United States Patent [19]

Alger

[11] Patent Number: 5,413,642

[45] Date of Patent: May 9, 1995

[54] PROCESSING FOR FORMING CORROSION AND PERMEATION BARRIERS

[76] Inventor: Donald L. Alger, 3419 W. 144th St., Cleveland, Ohio 44111

[21] Appl. No.: 982,485

[22] Filed: Nov. 27, 1992

[51] Int. Cl.[6] ..... C23C 8/16; C23C 14/08

[52] U.S. Cl. ..... 148/239; 148/242; 148/272; 148/277; 148/284; 148/285; 148/537

[58] Field of Search ..... 148/239, 241, 242, 269, 148/272, 277, 280, 284, 285, 518, 525, 537

[56] References Cited

U.S. PATENT DOCUMENTS

| | | | |
|---|---|---|---|
| 3,164,493 | 1/1965 | Lindberg | 148/6.3 |
| 3,660,173 | 5/1972 | Matsuno et al. | 148/280 |
| 3,732,690 | 5/1973 | Meijer | 60/39 |
| 4,197,707 | 4/1980 | Assno | 60/517 |
| 4,266,987 | 5/1981 | Wang | 148/280 |
| 4,312,641 | 1/1982 | Verrando et al. | 55/33 |
| 4,314,880 | 2/1982 | McGuire et al. | 376/146 |
| 4,335,884 | 6/1982 | Darche | 277/3 |
| 4,398,967 | 8/1983 | DeVan et al. | 148/6.11 |
| 4,487,637 | 12/1984 | Padamsee | 148/277 |
| 4,651,527 | 3/1987 | Alger | 60/517 |
| 4,929,287 | 5/1990 | Hirbod | 148/285 |
| 5,294,586 | 3/1994 | Sigler | 148/285 |

FOREIGN PATENT DOCUMENTS

| | | | |
|---|---|---|---|
| 2031955 | 4/1980 | United Kingdom | 148/239 |
| 2075556 | 11/1981 | United Kingdom | 148/285 |

OTHER PUBLICATIONS

Wale-Evans, G., Dissertation "Improvement of the Oxidation Wear Resistance of Steels by Means of Ion Implantation", presented 1979, pp. 1-3 and 30-45.

Metals Handbook, 9th. ed. vol. 13, pp. 56-76, ASM International, 1987.

Metallurgical Thermochemistry, Kubaschewski, et al, Pergamon Press, pp. 1-26 and 131-137.

"Metal-Metal Oxide-Hydrogen Atmosphere Chart for Brazing or Bright Metal Processing", Supplement to the Welding Research Journal, May 1970, pp. 189-192.

*Primary Examiner*—George Wyszomierski

*Attorney, Agent, or Firm*—Fay, Sharpe, Beall, Fagan, Minnich & McKee

[57] ABSTRACT

An alloy has less stable oxides, e.g. nickel oxide, chromium oxide, and iron oxide on a surface (FIG. 1). The material has specific reaction elements such as titanium and aluminum in a relatively low concentration throughout the alloy. At an elevated temperature, the surface of the alloy is subject to a fluid which reduces the nickel, chromium, and iron oxides and the aluminum or titanium adjacent the surface reduces components of the fluid (FIG. 2). The alloy is maintained at the elevated temperature in the presence of the fluid until a barrier film of the specific reactive elements is formed. In one embodiment, the working fluid is a gaseous fluid of hydrogen or an inert gas with water vapor. The hydrogen of the water vapor reduces the less stable oxides and the oxygen oxidizes the specific reaction elements. In another embodiment, the working fluid is a liquid metal other than lithium which carries oxygen. The liquid metal reduces the less stable oxides and provides oxygen for oxidizing the specific reactive elements. In a third embodiment, the working fluid is liquid lithium, which reduces both the less stable oxides and the oxides of the specific reactive elements. The lithium contains nitrogen or carbon which reacts with the least specific elements to form nitrides or carbides.

11 Claims, 3 Drawing Sheets

PROCESSING FOR FORMING CORROSION AND PERMEATION BARRIERS

BACKGROUND OF THE INVENTION

This invention relates to processes for forming a barrier layer on metal surfaces. The invention finds particular application in conjunction with forming barrier layers that resist hydrogen permeation, resist corrosion by liquid metals, resist wear and abrasion, and resist surface attacks by corrosive media.

Heretofore, various methods have been used to provide barriers or coatings that are resistant to the permeation of hydrogen. For example, the permeation of hydrogen and its isotopes, such as tritium, through the walls of nuclear reactors and their components, has been a problem that has never been completely solved. One method of reducing the rate of hydrogen permeation has been to form an intermetallic aluminide, specifically nickel aluminide, as a coating on certain metals to slow the loss of hydrogen. A drawback to this approach is the high temperature and long time required to form the barrier, and the effect of this time-temperature relationship upon the mechanical characteristics (tensile strength, fatigue strength, etc.) of the underlying alloy.

Another method was to use the naturally grown oxide scale on nickel-chromium alloys. However, these oxides are continually reduced by the hydrogen atmosphere. The continuous presence of water vapor is required in order to reform the oxides. Analogous hydrogen barriers have been used to slow the permeation of hydrogen from Stirling engines which contain high pressure hydrogen as the working fluid.

The corrosion of containment walls of systems that use liquid metals as the working fluid, e.g. nuclear reactor heat transport systems and sodium heat pipes, is another difficult problem that has never been totally solved. Nickel aluminide coatings have been used with some success, but the very high temperature required to form the aluminide can weaken the base material. In most of these systems, it is necessary to maintain the oxygen level extremely low in order to prevent oxygen enhanced corrosion reactions with component elements of the alloys, resulting in an eventual loss of containment.

The present invention relates to a new and improved technique for forming surface barriers which overcomes the above-referenced problems and others, and to the structures produced by such technique.

SUMMARY OF THE INVENTION

In accordance with one aspect of the present invention, an alloy which contains specific reactive elements is heated in the presence of a reducing/oxidizing atmosphere consisting of hydrogen containing a preferred, but not limited to, concentration of from 1 to 500 ppm of water vapor, at a sufficient temperature, preferably between 1000° F. and 2000° F., and for a sufficient duration to reduce surface oxides of non-specific reactive elements and to cause the oxidation of the surface specific reactive elements. The process of heating the alloy in the presence of the hydrogen/water vapor atmosphere is continued as additional specific reactive element atoms diffuse from the alloy to the surface and are oxidized.

In accordance with a more limited aspect of the present invention, the alloy is heated in the presence of a reducing/oxidizing atmosphere consisting of an inert gas containing a preferred, but not limited to, concentration of from 1 to 500 ppm of water vapor, at a sufficient temperature, preferably between 1000° F. and 2000° F., and for a sufficient duration to reduce surface oxides of non-specific reactive elements and to cause the oxidation of the surface specific reactive elements. The process of heating the alloy in the presence of the inert gas/water vapor atmosphere is continued as additional specific reactive element atoms diffuse from the alloy to the surface and are oxidized.

In accordance with a more limited aspect of the present invention, the alloy is heated in the presence of a reducing/oxidizing atmosphere consisting only of water vapor, over a preferred, but not limited to, partial pressure range of from $1\times10^{-5}$ to $1\times10^{-1}$ torr in a vacuum environment, at a sufficient temperature, preferably between 1000° F. and 2000° F., and for a sufficient duration to reduce surface oxides of non-specific reactive elements. The process of heating the alloy in the presence of the water vapor atmosphere is continued as additional specific reactive element atoms diffuse from the surface and are oxidized.

In accordance with a more limited aspect of the present invention, the alloy is heated in the presence of other reducing/oxidizing atmospheres such as a $CO$-$CO_2$ or other oxygen bearing gas mixture, over a range of gas mixture ratios, at sufficient temperature, preferably between 1000° F. and 2000° F., and for a sufficient duration to reduce surface oxides of non-specific reactive elements. The process of heating the alloy in the presence of the gas mixture reducing atmosphere is continued as additional specific reactive element atoms diffuse from the surface and are oxidized.

In accordance with another aspect of the present invention, a method is provided for forming a specific reactive element nitride barrier layer on a surface which contains specific reactive elements. A hydrogen/water vapor reducing atmosphere is heated and flowed over the surface. The reducing atmosphere is heated to a sufficient temperature, preferably between 1000° F. and 2000° F., to reduce non-specific reactive elements on the surface. Then, simultaneously, the source of reducing atmosphere is valved off and a flow of nitride forming gas consisting of hydrogen containing a preferred, but not limited to, concentration of from 1 to 500 ppm of nitrogen, ammonia or other nitrogen containing gas, is flowed over the specific reactive elements on the surface to form a specific reactive element nitride. The heated nitride forming atmosphere is maintained in contact with the surface for a sufficient duration to permit specific reactive element atoms within the alloy to diffuse to the surface and react to form the nitride barrier layer.

In accordance with another aspect of the present invention, a method is provided for forming a specific element carbide barrier layer on a surface which contains specific reactive elements. A hydrogen/water vapor reducing atmosphere is heated and flowed over the surface. The reducing atmosphere is heated to a sufficient temperature, preferably between 1000° F. and 2000° F., to reduce non-specific reactive elements on the surface. Then, simultaneously, the source of reducing gas atmosphere is valved off and a flow of carbide forming gas, consisting of hydrogen containing a preferred, but not limited to, concentration of from 1 to 500 ppm of methane or other hydrocarbons, is flowed over the specific reactive elements on the surface to form a specific reactive element carbide. The heated gas is maintained in contact with the surface for a sufficient duration to permit specific reactive element atoms within the alloy to diffuse to the surface and react to form the carbide barrier layer.

In accordance with a more limited aspect of the present invention, the alloy is implanted or diffused with atoms of the specific reactive element prior to being treated with any of the heated gaseous reducing/oxidizing atmospheres described above.

In accordance with another aspect of the present invention, a method is provided for forming a barrier layer on a surface of an alloy that contains specific reactive elements. A liquid metal which contains at least one of oxygen, a liquid metal oxide, nitrogen, a liquid metal nitride, carbon, and a liquid metal carbide is heated and immersed into or passed over the alloy surface. The liquid metal contains a preferred, but not limited to, concentration of from 1 to 500 ppm of oxygen, nitrogen or carbon, and is heated to a sufficient temperature, preferably between 1000° F. and 2000° F., such that the liquid metal reduces non-specific reactive element surface oxides and the specific reactive elements on the surface react to form one of an oxide, nitride, or carbide. The heated liquid metal is maintained in contact with the surface for a sufficient duration to permit specific reactive element atoms within the alloy to diffuse to the surface and react to form the oxide, nitride, or carbide.

In accordance with a more limited aspect of the present invention, the liquid metal is a liquid metal other than lithium, which liquid metal holds free oxygen or liquid metal oxide such that the specific reactive elements form an oxide.

In accordance with another more limited aspect of the present invention, the liquid metal is lithium which contains a preferred, but not limited to, concentration of from 1 to 500 ppm of nitrogen or lithium nitride, such that the specific reactive element atoms on the surface react to form a nitride.

In accordance with another more limited aspect of the present invention, the liquid metal is lithium which contains a preferred, but not limited to, concentration of from 1 to 500 ppm of carbon or lithium carbide, such that the specific reactive element atoms on the surface react to form a carbide.

In accordance with another more limited aspect of the present invention, the alloy is implanted or diffused with atoms of the specific reactive elements prior to being treated with the heated liquid metal.

In accordance with another limited aspect of the present invention the specific reactive elements include aluminum, titanium, zirconium, tantalum, columbium, silicon, beryllium, vanadium, manganese, uranium, magnesium, thorium, calcium, barium and rare earth elements, and combinations and alloys thereof.

One advantage of the present invention is that it provides a barrier that is resistant to permeation by hydrogen isotopes.

Another advantage of the present invention is that it forms a barrier which resists wear.

Yet another advantage of the present invention is that it forms a surface barrier which inhibits erosion.

Still another advantage of the present invention is that it facilitates the interface between two systems, each having different corrosion mechanisms and a different barrier film on the common metal alloy wall that separates the systems. For example, a lithium-to-sodium heat exchanger. The sodium side with a specific reactive element oxide barrier, and the lithium side with a specific reactive nitride barrier.

Still another advantage of the present invention is that it eliminates corrosion in liquid metal heat pipes by providing a corrosion barrier film on the heat pipe wick and container.

Still another advantage of the present invention is that the barrier films can minimize permeation of tritium from the primary loop of a gas-cooled reactor and minimize permeation of hydrogen from the secondary coolant gas loop into the primary loop.

Still another advantage of the present invention is that a titanium alloy can be treated by this process to produce a specific reactive element oxide corrosion resistant and hydrogen permeation resistant surface that is superior to the untreated titanium alloy surface.

Still further advantages of the present invention will become apparent to those of ordinary skill in the art upon reading and understanding the following detailed description of the preferred embodiment.

BRIEF DESCRIPTION OF THE DRAWINGS

The invention may take form in various steps and arrangements of steps an in various components and arrangements of components. The drawings are only for purposes of illustrating a preferred embodiment and are not to be construed as limiting the invention.

DETAILED DESCRIPTION OF THE PREFERRED EMBODIMENT

Figure 1:
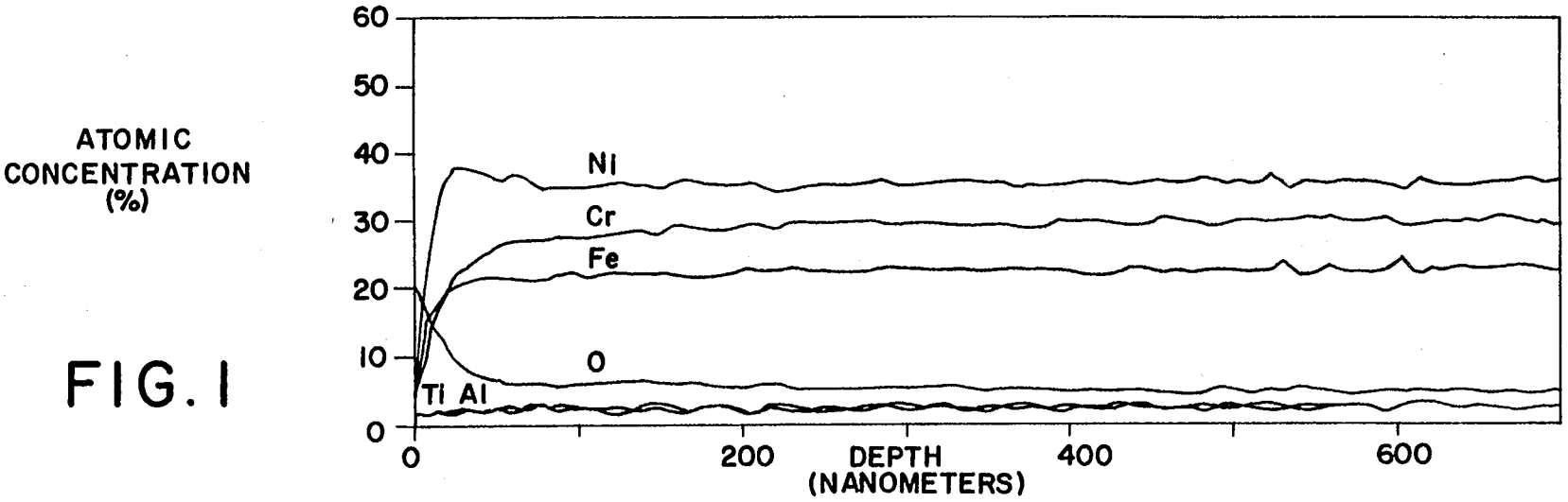
FIG. 1 illustrates atomic concentration versus depth for an Inconel alloy prior to treatment in accordance with the present invention.

The present application describes a process in which oxides of non-specific reactive elements are reduced. A higher concentration of the specific reactive elements is brought to the surface, and a highly stable oxide, nitride, or carbide of the specific reactive element is formed on the surface. Specific reactive elements are generally minor constituents of a bulk volume of material. The specific reactive elements include: aluminum, titanium, zirconium, tantalum, columbium, silicon, beryllium, manganese, uranium, vanadium, magnesium, thorium, calcium, barium, rare earth elements, such as hafnium, yttrium, etc., and combinations and alloys thereof.

In a first embodiment, the barrier is a specific reactive element oxide. A metal alloy which contains specific reactive elements, or a combination of such elements as constitutes components of the alloy, is modified such that the surface of the alloy forms a specific reactive element oxide film that resists corrosion, permeation by hydrogen isotopes, and serves other useful functions. Preferred alloys which contain specific reactive elements are listed in TABLE 1 below. Of these alloys, those with aluminum and titanium are preferred.

TABLE 1

| SPECIFIC REACTIVE ELEMENT (% OF ALLOY) | | | | | |
|---|---|---|---|---|---|
| Alloy | Al | Ti | Zr | Cb &/or Ta | V |
| Incoloy 925 | 0.3 | 2.1 | | | |
| Astroloy | 4.4 | 3.5 | | | |
| IN MA-754 | 0.3 | 0.5 | | | |
| IN MA-6000E | 4.5 | 2.5 | | | |
| Hastelloy C-4 | | 0.7 | | | |
| Hastelloy N | | 0.5 | | | |
| Hastelloy S | 0.2 | | | | |
| Hastelloy X | 2.0 | | | | |
| Hastelloy C-22 | | | | | 0.35 |
| Alloy C-276 | | | | | 0.35 |
| In-100 | 5–6 | 4.5–5.0 | | | 1.0 |
| In 102 | 0.5 | 0.5 | | | 3.0 |
| In 162 | 6.5 | 1.0 | | | |
| In 738 | 3.5 | 3.5 | 0.1 | 0.6–2.0 | |
| In 617 | 1.2 | 0.3 | | | |
| In 706 | 0.4 | 1.5–2.0 | | 2.5–3.3 | |
| In 718 | 0.2–.8 | 1.0 | | 4.7–5.5 | |
| In 722 | 0.7 | 2.5 | | | |
| In X-750 | 0.7 | 2.5 | | 0.7–1.2 | |
| In 751 | 1.2 | 2.3 | | 0.7–1/2 | |
| 713C | 6.1 | 0.8 | 0.1 | 2.0 | |
| 901 | 0.2 | 2.8 | | | |
| Nimonic 75 | 0.15 | 0.4 | | | |
| Nimonic 80A | 1.4 | 2.25 | | | |
| Nimonic 90 | 1.4 | 2.4 | | | |
| Nimonic 95 | 2.0 | 2.9 | | | |
| Nimonic 100 | 5.0 | 1.5 | | | |
| Nimonic 105 | 4.7 | 1.2 | | | |
| Nimonic 115 | 5.0 | 4.0 | | | |
| Nimonic 263 | 0.45 | 2.1 | | | |
| Pyromet 860 | 1.0 | 3.0 | | | |
| B-1900 | 6.0 | 1.0 | | 4.0 | |
| D-979 | 1.0 | 3.0 | | | |
| MAR-M-004 | 5.9 | 1.0 | | | |
| MAR-M-200 | 5.0 | 2.0 | | | |
| DS MAR-M-200 | 5.0 | 2.0 | | | |
| MAR-M-246 | 5.5 | 1.5 | | | |
| MAR-M-247 | 5.5 | 1.0 | | | |
| MAR-M-421 | 4.3 | 1.7 | | | |
| MP-159 | 0.2 | 3.0 | | | |
| Udimet 500 | 2.8 | 2.8 | | | |
| Udimet 700 | 4.0 | 3.5 | | | |
| Udimet 710 | 2.5 | 5.0 | | | |
| Udimet 720 | 2.5 | 5.0 | | | |
| Unitemp AF2-1DA | 4.6 | 3.0 | | | |
| Waspaloy | 1.3 | 3.0 | | | |
| Nicrotung | 4.0 | 4.0 | | | |
| Rene-41 | 1.5 | 3.2 | | | |
| Rene-80 | 3.0 | 5.0 | | | |
| Rene-95 | 3.5 | 2.5 | | | |
| Rene-100 | 5.5 | 4.2 | | | |
| GMR-235-D | 3.5 | 4.2 | | | |
| Hastelloy S | 0.2 | | | | |
| Refractory 26 | 0.2 | 2.6 | | | |
| 19-9L | | 0.3 | | | |
| Discoloy | 0.35 | 1.7 | | | |
| A-286 | 0.2 | 2.2 | | | |
| V-57 | 0.25 | 3.0 | | | |
| Incoloy 800 | 0.38 | 0.38 | | | |
| Incoloy 801 | | 1.13 | | | |
| Incoloy 802 | 0.58 | 0.75 | | | |
| Incoloy 901 | | 2.7 | | | |
| Incoloy 903 | 0.7 | 1.4 | | 3.0 | |
| Incoloy 907 | 0.03 | 1.5 | | | |
| Incoloy 909 | 0.03 | 1.5 | | | |
| Incoloy MA 956 | 4.5 | 0.5 | | | |
| Steels: | | | | | |
| H-11 | | | | | 1.4 |
| 9Ni-4Co | | | | | 0.1 |
| 18-Ni Maraging | | 0.22 | | | |
| 302-M | | | | | 0.08 |
| 4330, Vmod | | | | | 0.07 |
| Stainless W | 0.4 | 1.2 | | | |
| 17.7 PH | 1.0 | | | | |
| PH 15-7Mo | 1.0 | | | | |
| 17-14 CuMo | | 0.25 | | 0.45 | |
| AM-362 | | 0.8 | | | |
| AM-363 | | 0.5 | | | |
| PH 13-8Mo | 1.2 | | | | |

TABLE 1-continued

| SPECIFIC REACTIVE ELEMENT (% OF ALLOY) | | | | | |
|---|---|---|---|---|---|
| Alloy | Al | Ti | Zr | Cb &/or Ta | V |
| PH 14-8Mo | 1.1 | | | | |
| 16-6 PH | 0.35 | 0.40 | | | |
| Custom 455 | | 1.2 | | | |
| 405 SS | 0.2 | | | | |
| MF-1 SS | | 0.5 | | | |
| MF-2 SS | 1.0 | 0.6 | | | |
| Uniloy 326 | | 0.2 | | | |
| 18SR | 2.0 | 0.4 | | | |
| Nitronic | | | | 0.2 | 0.2 |
| Nivco | 0.22 | 1.8 | 1.1 | | |
| MAR-M-302 | | | 0.2 | | |
| MAR-M-322 | | 0.75 | 2.3 | 4.5 | |
| MAR-M-509 | | 0.2 | 0.5 | 3.5 | |
| S-816 | | | | 4.0 | |
| V-36 | | | | 2.3 | |
| J-1570 | | 4.0 | | | |
| J-1650 | | 3.8 | | 2.0 | |
| Ti-6Al-4V | 5.68 | 89.8 | | | 4.13 |
| Ti-8Al-4V | 7.51 | 88.0 | | | 4.11 |
| Ti-6Al-2V | 5.68 | 91.8 | | | 2.10 |
| Ti-4Al-6V | 3.69 | 89.8 | | | 6.10 |
| Ti-6Al-4V-5Zr | 5.63 | 84.4 | 5.34 | | 4.15 |
| Ti-6Al-2Nb-1Ta | 6.2 | 90.3 | | 0.9 | |

Figure 3:
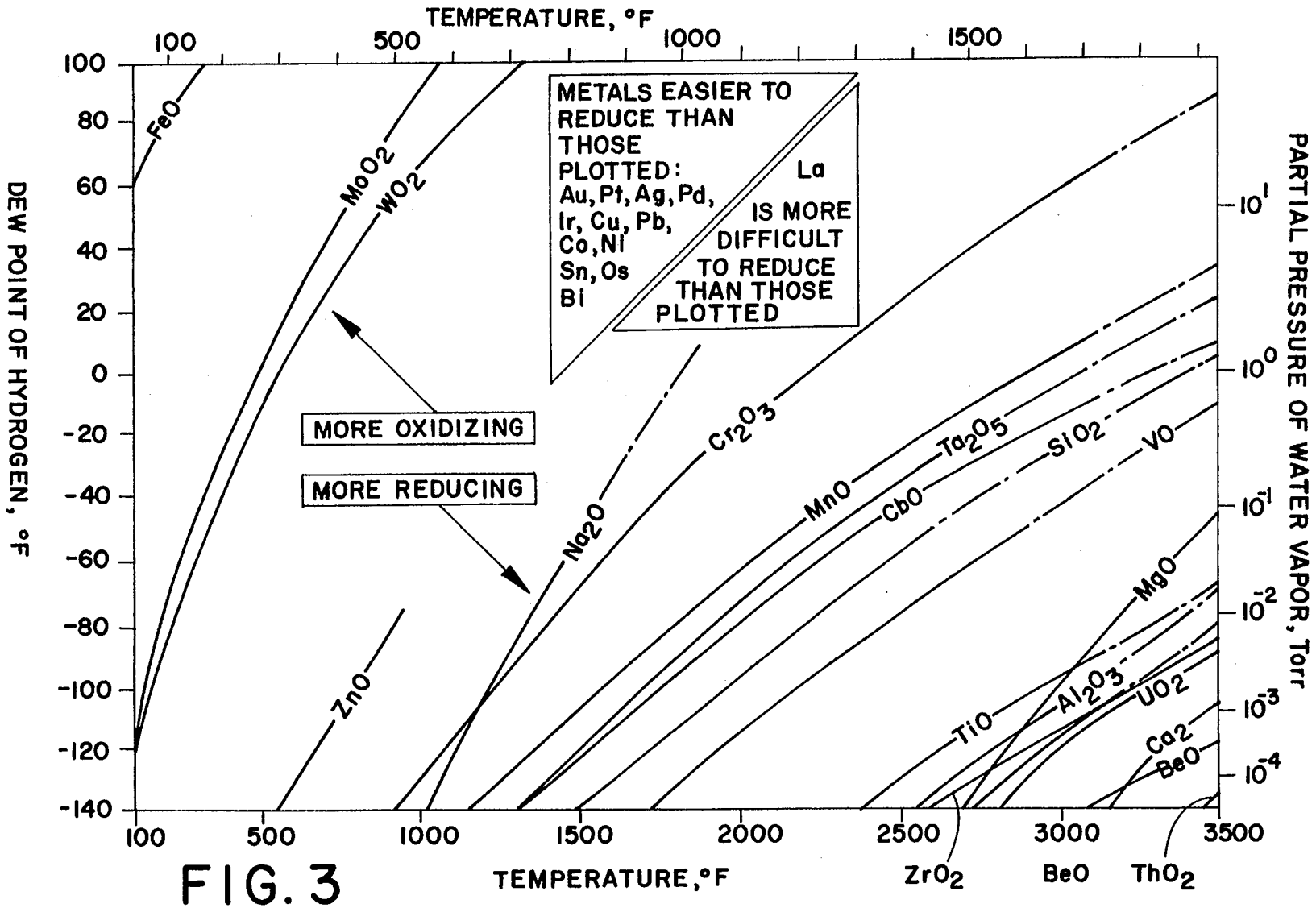
FIG. 3 is a metal-metal oxide-hydrogen atmosphere chart that graphically depicts known metal-metal oxide equilibrium curves; and, FIG. 4 is a graphic depiction of known dew point versus water content relationships.
Figure 4:
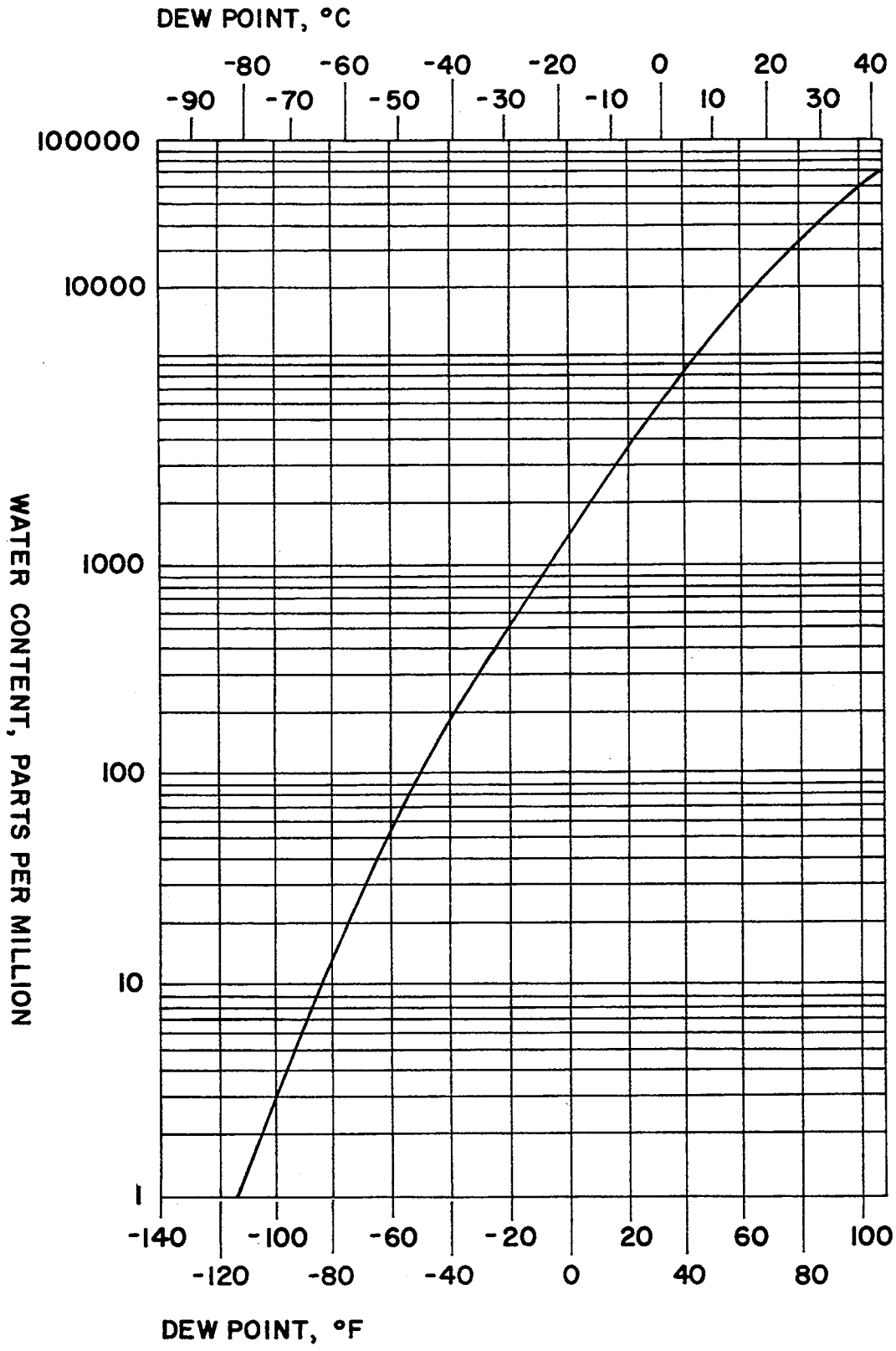

With reference to FIG. 1, in one method of forming the surface film, an alloy, such as a nickel-base Inconel 718, contains specific reactive elements of aluminum and titanium. The alloy is heated to an elevated temperature, preferably about 1750° F., in an environment of hydrogen, with a partial pressure of water vapor, preferably about 170 ppm. The temperature is high enough and the partial pressure of the water vapor low enough to reduce the less stable surface oxides of the non-specific reactive elements, such as iron, nickel, and chromium. The criteria for selecting the optimum proportion of reducing agent and oxidizing agent, as well as the other process parameters like temperature and pressure, is that the reducing/oxidizing atmosphere must be capable of reducing all non-specific reactive element oxides on the alloy surface. Reduction of a metal oxide in a hydrogen atmosphere occurs by the reduction reaction: metal oxide = metal + oxygen. As soon as oxygen is formed, hydrogen can react with the oxygen to form water vapor. For the reduction process to continue, at a chosen temperature, the dissociation pressure of the metal oxide must be larger than the partial pressure of water vapor. If this is not the case, the reaction is reversed and the metal surface is oxidized. A guide in selecting an appropriate balance of these parameters for a hydrogen/water atmosphere is shown in prior art FIG. 3 which is from "A Metal-Metal Oxide-Hydrogen Atmosphere Chart", Bredzs and Tennenhouse. Metal-Metal Oxide equilibrium curves are shown for several elements. For example, to reduce the surface iron, nickel and chromium oxides on an Inconel surface at 1800° K., a partial pressure of water vapor of about $1\times10^{-1}$ torr (or a hydrogen dew point of at least −40° F.) is needed. As shown in FIG. 4, also from the Bredzs and Tennenhouse reference, this dew point corresponds to about 170 ppm of water vapor. If the water vapor partial pressure increased to 1 torr, at the same temperature, the chromium oxides would not be reduced. It should be clear to anyone studying FIG. 3 that oxides, shown on the lower right-hand corner of the chart, including aluminum and titanium oxides, are not reduced under these conditions. Alternatively, one can obtain the reduction parameters from standard reference texts or at least the parameters for performing well-known thermochemical calculations for the non-specific elements and the specific reactive elements of interest. In practice, the reducing/oxidizing atmosphere is usually flowed over the metal part being treated so that the proportion of reducing and oxidizing agents can be better controlled.

In order to form the desirable specific reactive element oxide barrier film, the less stable oxides are reduced, especially chromium oxide. As the less stable surface oxides are reduced by hydrogen, aluminum and titanium atoms are exposed to the fresh oxygen produced by the dissociation of the water vapor and from the dissociation of the less stable surface metal oxides. These aluminum and titanium atoms react with the oxygen to produce strong stable aluminum and titanium oxides. These specific reactive element oxides are too stable to be reduced by the hydrogen/water vapor atmosphere.

Figure 2:
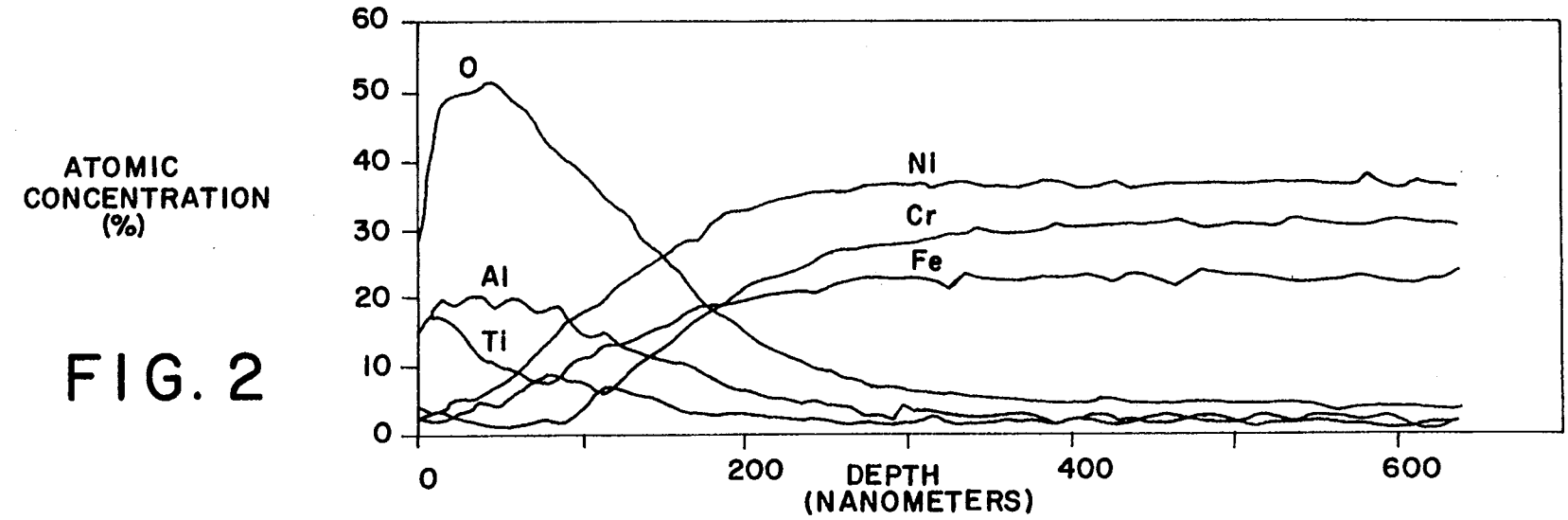
FIG. 2 illustrates atomic concentration versus depth for the Inconel alloy of FIG. 1 after treatment in accordance with the present invention.

After the aluminum and titanium atoms have reacted at the surface of the alloy to form the stable oxides, the heating is continued such that aluminum and titanium atoms from beneath the surface continuously diffuse to the surface from the bulk metal to react with the oxygen at the surface and continue to form stable aluminum and titanium oxides. Without interference from the less stable iron, nickel, and chromium oxides, which are instantly reduced under these conditions, the oxygen reacts quickly with the aluminum and titanium atoms as they arrive at the surface. The mean concentration of aluminum and titanium atoms at the surface is initially very small (note FIG. 1) as compared to the concentration of the other atoms in the bulk alloy. Therefore, there is a steep concentration gradient of aluminum and titanium atoms from the bulk material to the surface. This steep gradient contributes to a rapid diffusion of the aluminum and titanium atoms to the surface. It has been shown experimentally that both aluminum and titanium atoms diffuse at a rate that is hundreds of times faster than would be expected to occur by conventional Fick's law diffusion. It appears that the diffusion which occurs is vacancy diffusion. Aluminum and titanium are considered as substitutional solutes in the alloy solid solution with the diffusion being controlled by the number of vacancies and the mobility of these vacancies. With time, an aluminum and titanium oxide surface film is formed as shown in FIG. 2.

Preferably, this process is carried out in a hydrogen atmosphere which contains a partial pressure of water vapor. This reducing/oxidizing atmosphere is selected to be capable of reducing all non-specific reactive element oxides on the alloy surface. The appropriate temperature and partial pressure of water vapor, or "dew point" for this process is estimated from the charts shown in FIGS. 3 and 4. Alternatively, thermochemical calculations can be performed as is known in the art.

In another embodiment for forming the specific reactive element oxide surface barrier, an inert gas such as helium or argon is used at a pressure of about 1 atmosphere with the same partial pressure of water vapor as used for the hydrogen/water vapor atmosphere. At elevated temperature, the water vapor becomes the reducing/oxidizing atmosphere. The partial pressure of water vapor and gas temperature are selected in accordance with FIG. 3 to create a reducing atmosphere which reduces the non-specific element oxides on the alloy surface. The inert gas reducing/oxidizing atmosphere is preferably flowed over the metal part being treated so that the proportion of water vapor and oxygen are better controlled.

The total pressure of the inert gas/water vapor is not a particularly important parameter and may be substantially more or less than 1 atmosphere. For example, it may be advantageous during heat treatment of the alloy in a hot isostatic pressure (HIP) furnace, at several hundred psi of inert gas, to select the water vapor partial pressure such that a barrier film forms.

In an alternate embodiment, the partial pressure of water vapor alone, in a vacuum environment, is the reducing/oxidizing atmosphere.

In yet another embodiment for forming the specific reactive element oxide surface barrier, other reducing/oxidizing atmospheres, for example $CO$-$CO_2$ and other oxygen bearing compounds, are used in a similar manner as a hydrogen/water vapor mixture. The final criteria involved in the selection and use of the correct atmosphere is whether the mixture, over a preferred temperature range of from 1000° F. to 2000° F., and for various gas mixture ratios, is capable of reducing the nonspecific reactive element surface oxides so that a specific reactive element oxide barrier film can form. The reducing/oxidizing gas mixture is preferably flowed over the metal part being treated.

In another method of forming the specific reactive element oxide barrier, a liquid metal, such as sodium, potassium, etc. is used as the reducing medium. Any other liquid metal is acceptable as long as it is capable of reducing all present surface non-specific reactive element oxides (i.e., iron oxide, nickel oxide, chromium oxide, etc.) that are less stable than the specific reactive element oxides. The liquid metal reduces these less stable oxides at a lower temperature than the hydrogen/water vapor atmosphere. Liquid metal oxides are more stable than iron oxide, nickel oxide, and chromium oxide. Therefore, these surface non-specific reactive element oxides are readily reduced by the liquid metal to form liquid metal oxides.

The liquid metal contains a preferred, but not limited to, concentration of from 1 to 500 ppm of oxygen or liquid metal oxide. The liquid metal is heated to a sufficient temperature, preferably between 1000° F. and 2000° F., to reduce surface oxides of the non-specific reactive elements. The exposed specific reactive element atoms directly react with oxygen in the liquid metal to form stable specific reactive element oxides. If the liquid metal contains liquid metal oxides, the exposed specific reactive element atoms first react with the liquid metal oxides to release oxygen, which then reacts with the specific reactive element atoms to form stable specific reactive element oxides.

Heating is continued such that specific reactive element atoms from beneath the surface diffuse rapidly to the surface and react with the oxygen or liquid metal oxide and form the specific reactive element oxide barrier film. Oxygen or liquid metal oxide are added periodically, as needed, to the liquid metal to assure a sufficient supply of oxygen for reacting with the specific reactive element atoms to form the specific reactive element oxide barrier film to the desired thickness. The temperature can be lower than in the gaseous reducing/oxidizing atmosphere embodiment. However, one criteria with regard to a lower limit on the temperature is the temperature dependent rate at which the specific reactive element atoms diffuse to the surface. That is, the liquid metal and the bulk material are maintained at a sufficiently high temperature that the barrier film is formed in an acceptable time.

Specific reactive element nitrides are also effective barrier films. Liquid lithium is used as the liquid metal working fluid. Lithium reduces both the less stable non-specific reactive element oxides and the specific reactive element oxides.

The liquid lithium contains a preferred, but not limited to, concentration of from 1 to 500 ppm of nitrogen or lithium nitride. The liquid lithium is heated to a sufficient temperature, preferably between 1000° F. and 2000° F., to reduce surface oxides which includes non-specific reactive element as well as most specific reactive element oxides. The lithium oxide that is formed diffuses into the liquid lithium. The specific reactive element atoms react directly with the nitrogen to form specific reactive element nitrides and/or reduce the lithium nitride, releasing nitrogen to form more specific reactive element nitrides. Heating of the alloy part to be processed is continued such that specific reactive element atoms from beneath the surface diffuse to the surface and react with the nitrogen or lithium nitride to form more specific reactive element nitrides. Nitrogen or lithium nitride are added periodically to the liquid lithium to assure a sufficient supply of nitrogen. Preferably, the liquid lithium is circulated through appropriate traps, common in the liquid metal industry, to remove the oxygen and lithium oxide that is formed by reduction of surface oxides on the alloy part. A lower limit on temperature is the temperature dependent rate at which the specific reactive element atoms diffuse to the surface. That is, the liquid lithium and alloy are maintained at a sufficiently high temperature that the nitride barrier film is formed in an acceptable time. The process is continued until a specific reactive element nitride film of a selected thickness is formed. All competing contaminant reactions should be minimized by maintaining a high purity of liquid lithium. For example, lithium should not be contaminated with carbon or lithium carbide.

An analogous process is used to generate specific reactive element carbide barrier films. The liquid lithium contains a preferred, but not limited to, concentration of from 1 to 500 ppm of carbon or lithium carbide. The process to form the specific reactive element carbide films is identical to the process described in the preceding paragraphs for forming specific reactive element nitrides with the word substitution of "carbon" for "nitrogen" and "carbide" for "nitride" in that description. It should be understood that if one wants to create a pure carbide film, all competing contaminant reactions should be minimized by maintaining the high purity of the liquid lithium. For example, the lithium should not be contaminated with nitrogen or lithium nitride.

In another method of forming the specific reactive element nitride barrier film, the alloy specimen is first cleaned, degreased and placed in a hydrogen tube furnace. Hydrogen, containing less than 10 ppm of water vapor is flowed over the specimen as the furnace is heated to between 1000° F. and 2000° F. for a sufficient time to reduce the non-specific reactive element oxides on the surface of the specimen. The period of time is preferably determined by placing an oxygen monitor in the effluent of the furnace and measuring oxygen content until a minimum content is reached. The flow rate of hydrogen is sufficient to sweep away most oxygen that has been formed by reduction of non-specific reactive element oxides on the surface of the specimen. When the non-specific element oxides have been reduced, a second source of hydrogen containing a preferred, but not limited to, concentration of from 1 to 500 ppm of nitrogen, ammonia or other nitrogen bearing gas, is flowed over the specimen as the first source of hydrogen is simultaneously valved off. Specific reactive element surface atoms react with nitrogen to form a stable specific reactive element nitride on the surface. As the nitride is formed, more specific reactive element atoms diffuse from beneath the surface and react with nitrogen to continue formation of the nitride barrier to the desired thickness.

In another method of forming the specific reactive element carbide film, the identical process as described for formation of the nitride barrier is performed up to the point of introducing the second source of hydrogen. For formation of the carbide, the second source of hydrogen containing a preferred, but not limited to, concentration of from 1 to 500 ppm of methane or hydrocarbons, is flowed over the specimen as the first source of hydrogen is simultaneously valved off. Specific reactive surface element atoms react with carbon from the methane or hydrocarbons to form a stable specific reactive element carbide on the surface. As the carbide is formed, more specific reactive element atoms diffuse form beneath the surface and react with carbon to continue formation of the carbide barrier form to the desired thickness.

The above-described barrier forming method is also used on materials, including metals, alloys, composites, ceramics and the like, that do not contain specific reactive elements as constituents provided these materials are compatible with the gaseous reducing/oxidizing atmospheres or liquid metals described above. "Compatible" means that the materials do not react in a manner to interfere with the processes previously described for forming barrier films. In a first or preliminary step, specific reactive elements or an alloy or mixture of the specific reactive element is physically coated on or diffused or implanted into the surface on which the barrier film is to be formed. The surface may be physically coated by mechanical, chemical, electrical, magnetic, or thermal methods such as chemical or electrical deposition, sputtering, ion plating, or the like. The specific reactive element or the alloy may also be diffused or implanted, such as by ion implantation into the surface of the bulk material. Once the specific reactive element has been added to the bulk material, then one of the above-described processes for forming oxide, nitride, or carbide barrier films is employed.

With reference to the preferred embodiment, the material of the containers, and the internal surface of the containers in which the alloy part is placed for formation of the oxide, nitride, or carbide barrier films, requires special selection and/or preparation. The internal surface of the containers should be as inert as possible toward the liquid metal or gaseous atmosphere it contains. For example, if the liquid metal is sodium, molybdenum would be a good container choice since minimal reaction occurs between sodium and molybdenum. An alternative method is to use the same alloy for the process container as the alloy part being processed. For example, if an oxide barrier film is being formed, the container is processed first to create an oxide barrier film on the internal surface. Then, the process procedure is repeated to form the barrier oxide film on the surface of an alloy part to be processed within the container. Standard state-of-the-art cleaning, degreasing and vacuum bakeout procedures, which are used in the liquid metal and vacuum industry, are applicable in preparation of the process container and alloy part surfaces prior to initiating the process. Gases and liquid metals used in the described processes are considered to be pure, without contaminants. The final criteria in determining the degree of surface cleaning necessary or the purity of gas and liquid metal needed is whether the cleanliness and purity is good enough to carry out the processes described without interference from contaminants. In a pilot program to tailor a barrier film process for a specific application, it is probable that ultra-clean surfaces and ultra-pure gases or liquid metals will first be used. As the specific application is defined, lower cost approaches can be used as long as an effective barrier film is still formed.

The invention has been described with reference to the preferred embodiment. Obviously, modifications and alterations will occur to others upon reading and understanding the preceding detailed description. It is intended that the invention be construed as including all such modifications and alterations insofar as they come within the scope of the appended claims or the equivalents thereof.

Having thus described the preferred embodiment, the invention is now claimed to be:

1. A method of forming a specific reactive element oxide on a surface of an alloy material essentially free of contaminants, which alloy material contains specific reactive element atoms selected from the group consisting of: aluminum, titanium, zirconium, tantalum, columbium, silicon, beryllium, manganese, uranium, vanadium, magnesium, thorium, calcium, barium, rare earth elements, and combinations thereof; and atoms whose oxides are less stable than oxides of the specific reactive element atoms, selected from the group consisting of iron, nickel and chromium oxides, the method comprising:

placing at least the surface and contiguous regions of the alloy material in a fluid consisting of a flowing gaseous hydrogen/water vapor atmosphere at an elevated temperature between about 1000° F. to about 2000° F, and containing a concentration of from about 1 ppm to about 500 ppm of water vapor, the gaseous hydrogen/water vapor atmosphere being monitored and controlled in a manner to maintain a set temperature and water vapor concentration within these ranges, such that the gaseous hydrogen/water vapor atmosphere reduces said less stable element oxides at the alloy material surface, and reacts the specific reactive element atoms at the alloy material surface only with oxygen to form a specific reactive element oxide, the forming of the oxide causing a specific reactive element atom concentration gradient between the surface and interior of the alloy material; and continuing to immerse the alloy material surface in the gaseous hydrogen/water vapor atmosphere at the elevated temperature such that the specific reactive element atom concentration gradient causes the specific reactive atoms in the alloy material interior to diffuse to the surface and react with oxygen until a uniform, lateral growth of specific reactive element oxide barrier layer with less stable element oxides excluded, is formed, the barrier layer being strongly bonded to the alloy material surface.

2. The method as set forth in claim 1 wherein the gaseous atmosphere includes an inert gas.

3. The method as set forth in claim 1 wherein the gaseous atmosphere consists only of water vapor and its reaction products hydrogen and oxygen in a vacuum environment.

4. The method as set forth in claim 1 wherein the gaseous atmosphere includes a $CO$-$CO_2$ mixture.

5. The method as set forth in claim 1 further including before the step of placing the alloy material in the gaseous atmosphere, adding atoms of the specific reactive element to the material by at least one of physically coating by mechanical, electrical, magnetic, or thermal methods, chemical deposition, electrical deposition, sputtering, ion plating, diffusion, implantation, and ion implantation.

6. A method of forming a specific reactive element barrier layer on a surface of a material which contains specific reactive element atoms and element atoms which form less stable element oxides than the specific reactive element atoms, the method comprising:

placing at least the surface in contact with a liquid metal which contains oxygen, such that the liquid metal reduces less stable element oxides at the surface and the specific reactive element atoms at the surface react only with the oxygen, to form a specific reactive element oxide, the forming of the the specific reactive element oxide, causing a specific reactive element atom concentration gradient between the surface and interior of the material;

continuing to keep the material in contact with the liquid metal working fluid and at a sufficiently elevated temperature that the specific reactive element atom concentration gradient causes the specific reactive atoms in the material interior to diffuse to the surface and react with the oxygen, until a uniform, lateral growth of specific reactive element oxide barrier layer with less stable element oxides excluded is formed strongly bonded to the alloy surface.

7. The method as set forth in claim 6 wherein the liquid metal is a liquid metal other than lithium which contains oxygen as one of oxygen and lithium metal oxide such that the lithium reduces the less stable surface oxides and the free oxygen or lithium metal oxide reacts with the specific reactive element atoms to form a specific reactive element oxide barrier layer.

8. The method as set forth in claim 6 further including before the step of placing the material in the liquid metal, adding atoms of the specific reactive element to the material by at least one of physically coating by mechanical, electrical, magnetic, or thermal methods, chemical deposition, electrical deposition, sputtering, ion plating, diffusion, implantation, and ion implantation.

9. The method as set forth in claim 6 wherein the oxygen, is present in the liquid metal in a concentration between 1 ppm and 500 ppm and the liquid metal is at a temperature between 1000° F. and 2000° F.

10. A method of forming a specific reactive element oxide on a surface of an alloy material essentially free of contaminants, which alloy material contains specific reactive element atoms selected from the group consisting of: aluminum, titanium, zirconium, tantalum, columbium, silicon, beryllium, manganese, uranium, vanadium, magnesium, thorium, calcium, barium, rare earth elements, and combinations thereof; and atoms whose oxides are less stable than oxides of the specific reactive element atoms, selected from the group consisting of iron, nickel and chromium oxides, the method comprising:

placing at least the surface and contiguous regions of the alloy material in a fluid consisting of a flowing liquid metal other than lithium at an elevated temperature between about 1000° F. to 2000° F., and containing a concentration of from about 1 ppm to about 500 ppm of oxygen, the liquid metal being monitored and controlled in a manner to maintain a set temperature and oxygen concentration within these ranges, such that the liquid metal reduces said less stable element oxides at the alloy material surface, and reacts the specific reactive element atoms at the alloy material surface only with oxygen to form a specific reactive element oxide, the forming of the oxide causing a specific reactive element atom concentration gradient between the surface and interior of the alloy material; and continuing to immerse the alloy material surface in the liquid metal, at the elevated temperature such that the specific reactive element atom concentration gradient causes the specific reactive atoms in the alloy material interior to diffuse to the surface and react with oxygen until a uniform, lateral growth of specific reactive element oxide barrier layer, with less stable element oxides excluded, is formed, the barrier layer being strongly bonded to the alloy material surface.

11. The method as set forth in claim 10 further including before the step of placing the alloy material in the liquid metal, adding atoms of the specific reactive element to the material by at least one of physically coating by mechanical, electrical, magnetic, or thermal methods, chemical deposition, electrical deposition, sputtering, ion plating, diffusion, implantation, and ion implantation.

* * * * *